US010419845B2

(12) United States Patent
Muramoto et al.

(10) Patent No.: US 10,419,845 B2
(45) Date of Patent: Sep. 17, 2019

(54) HEADPHONES AND SPEAKER UNIT

(71) Applicant: ONKYO CORPORATION, Osaka (JP)

(72) Inventors: Shun Muramoto, Osaka (JP); Akira Tamadera, Osaka (JP); Takashi Ouchi, Osaka (JP)

(73) Assignee: ONKYO CORPORATION, Osaka (JP)

( * ) Notice: Subject to any disclaimer, the term of this patent is extended or adjusted under 35 U.S.C. 154(b) by 0 days.

(21) Appl. No.: 15/951,524

(22) Filed: Apr. 12, 2018

(65) Prior Publication Data

US 2018/0310093 A1 Oct. 25, 2018

(30) Foreign Application Priority Data

Apr. 24, 2017 (JP) ..... 2017-085725

(51) Int. Cl.
*H04R 1/10* (2006.01)
*H04R 1/28* (2006.01)
(Continued)

(52) U.S. Cl.
CPC ..... *H04R 1/2849* (2013.01); *H04R 1/10* (2013.01); *H04R 1/1008* (2013.01);
(Continued)

(58) Field of Classification Search
CPC ..... H04R 1/10; H04R 1/1008; H04R 1/2823; H04R 1/2849; H04R 1/2873; H04R 1/2876; H04R 5/033; H04R 2420/07
(Continued)

(56) References Cited

U.S. PATENT DOCUMENTS 3,999,020 A * 12/1976 Bastiaans ..... H04R 1/1041 381/372
4,742,887 A * 5/1988 Yamagishi ..... H04R 1/2857 181/129
(Continued)

FOREIGN PATENT DOCUMENTS

CN 203590402 5/2014
JP 1984121989 8/1984
(Continued)

OTHER PUBLICATIONS

Extended Search Report for corresponding European Application No. 18168921.7 dated Sep. 10, 2018.

*Primary Examiner* — Huyen D Le
(74) *Attorney, Agent, or Firm* — Renner, Otto, Boisselle & Sklar, LLP

(57) ABSTRACT

There are provided headphones and a speaker unit having proper acoustic properties and exhibiting excellent reproduced sound quality even in the case of providing air holes at a damping member. The headphones include a speaker unit having a diaphragm and a frame supporting an outer peripheral portion of the diaphragm, a housing configured to house the speaker unit, and a damping member made of a material exhibiting air permeability and attached to cover an opening of the frame through which a sound wave emitted from the diaphragm passes and/or an opening of the housing. The damping member has one or more air holes formed by removal of the material forming the damping member. A secondary damping member is attached to an annular edge portion defining each air hole, thereby reducing vibration of the edge portion.

3 Claims, 3 Drawing Sheets

(51) Int. Cl.
*H04R 7/16* (2006.01)
*H04R 5/033* (2006.01)

(52) U.S. Cl.
CPC ..... *H04R 1/2834* (2013.01); *H04R 1/2873* (2013.01); *H04R 1/2876* (2013.01); *H04R 5/033* (2013.01); *H04R 7/16* (2013.01); *H04R 1/2823* (2013.01); *H04R 2420/07* (2013.01)

(58) Field of Classification Search
USPC ..... 381/345, 346, 348, 349, 353, 354, 370, 381/372, 373; 181/129, 130, 135
See application file for complete search history.

(56) References Cited

U.S. PATENT DOCUMENTS

| | | | | |
|---|---|---|---|---|
| 2015/0117693 | A1* | 4/2015 | Akino ..... | H04R 1/1008 381/370 |
| 2016/0142812 | A1* | 5/2016 | Honda ..... | H04R 5/033 381/372 |
| 2016/0142813 | A1 | 5/2016 | Honda et al. | |

FOREIGN PATENT DOCUMENTS

| | | |
|---|---|---|
| JP | 1984177287 | 11/1984 |
| JP | 1986109287 | 7/1986 |
| JP | 2011087098 | 4/2011 |
| JP | 2013251660 | 12/2013 |

* cited by examiner

HEADPHONES AND SPEAKER UNIT

BACKGROUND OF THE INVENTION

1. Field of the Invention

The present invention relates to a speaker unit of headphones and earphones attached to user's ears to reproduce audio, and specifically relates to headphones and a speaker unit having a damping member through which a sound wave emitted from a diaphragm passes.

2. Description of the Related Art

Each of headphones includes a speaker unit, a housing surrounding a backside of the speaker unit, and an ear contact portion provided on a front side of the speaker unit. The headphones include headphones having a pair of right and left housings coupled together through a headband, earphones configured such that housings are directly supported in user's ears, and a so-called headset including a microphone device at a housing.

Among the headphones of this type, there are headphones configured such that a damping member which exhibits air permeability and through which a sound wave emitted from a diaphragm passes is provided at each speaker unit or each housing. With the damping members, the headphones change properties of an acoustic equivalent circuit formed by the speaker units and the housings, thereby improving sound pressure frequency properties etc. Each damping member at the headphones is mainly formed of a member exhibiting air permeability so that air permeability (air flow rate) of an opening through which the sound wave emitted from the diaphragm to a front or back side thereof passes can be adjusted.

For example, headphones characterized in that an acoustic transducer and a housing attached to the acoustic transducer are provided, the housing is in a duct shape allowing transmission of sound emitted from a back surface of the acoustic transducer and has at least one surface provided with a through-hole, and a damping material is provided for the through-hole have been typically disclosed in JP-UM-A-59-177287. The damping material selected from fabric, a urethane material, etc. functions as a resistive component in an acoustic equivalent circuit. Moreover, headphones configured such that openings are provided at multiple backside spots of a diaphragm of each headphone unit as an electrodynamic speaker unit and damping fabric as a damping material exhibiting air permeability is bonded to the openings to adjust the amount of air passing from the diaphragm to a back side have been typically disclosed in JP-UM-A-61-109287. Further, headphones configured such that a through-hole is provided at a terminal board to perform acoustic damping have been also disclosed in JP-UM-A-61-109287.

Specifically, a damping member of headphones is formed of a fibrous member allowing passage of air as a sound wave medium. For example, the damping member is formed of a fibrous member exhibiting air permeability, such as a paper member, a non-woven fabric member, or a woven fabric member. In the fibrous member formed of entangled short and long fibers, a clearance allowing air passage is formed between adjacent ones of the fibers, and therefore, the fibrous member can be used as the damping member requiring air permeability. Alternatively, the damping member may be a cushion material or a foamed material as a porous member exhibiting air permeability, such as foamed urethane.

The damping member of the headphones is attached to cover an opening of a frame of a speaker unit or an opening of a housing configured to house the speaker unit while an air hole for adjusting the flow rate of air in such an opening is further provided. For example, in a case where the damping member is a paper material, a hole as an air hole formed by removal of part of the paper material as fibers is sometimes further provided. Selection of the material of the damping member and setting of the air hole in the headphones change properties of an acoustic circuit in the headphones. This greatly influences basic sound pressure frequency properties, as well as greatly influencing the reproduced sound quality of the headphones.

For example, in a case where the damping member is formed of the paper member exhibiting air permeability, there is an advantage that the position, size, and number of air holes can be changed to easily design the acoustic properties and reproduced sound quality of the headphones. However, when the air hole is provided at the damping member, there might be the following problems: the strength of the damping member is decreased; and the periphery of the air hole with a great air flow rate easily vibrates, and for this reason, such vibration of the damping member needs to be reduced. In design of the headphones attached to the user's ears, an unnecessary sound wave emitted due to vibration of other members of the headphones than a diaphragm of the speaker unit provides a great adverse effect to the reproduced sound quality.

SUMMARY OF THE INVENTION

The present invention has been made to solve the problems of the above-described typical techniques, and an object of the present invention is to provide headphones and a speaker unit having a damping member on a front or back side of a diaphragm emitting a sound wave, specifically headphones and a speaker unit having proper acoustic properties and exhibiting reproduced sound quality even in a case where an air hole is provided at a damping member.

The headphones of the present invention include a speaker unit having a diaphragm and a frame supporting an outer peripheral portion of the diaphragm, a housing configured to house the speaker unit, and a damping member made of a material member exhibiting air permeability and attached to cover an opening of the frame through which a sound wave emitted from the diaphragm passes and/or an opening of the housing. The damping member has one or more air holes formed by removal of the material forming the damping member. A secondary damping member is attached to an annular edge portion defining each air hole, thereby reducing vibration of the edge portion.

Preferably, in the headphones of the present invention, the secondary damping member is any of a paper member, a non-woven fabric member, a woven fabric member, and a porous member formed in an annular shape according to the shape of the edge portion defining each air hole.

Moreover, the headphones of the present invention include a speaker unit having a diaphragm and a frame supporting an outer peripheral portion of the diaphragm, a housing configured to house the speaker unit, and a damping member made of a material exhibiting air permeability and attached to cover an opening of the frame through which a sound wave emitted from the diaphragm passes and/or an opening of the housing. The damping member has one or more air holes formed by removal of the material forming the damping member. The frame and/or the housing has an air hole edge fixing portion extending inward of the opening from a base defining the opening to fix an annular edge portion defining each air hole of the damping member, thereby reducing vibration of the edge portion.

Preferably, in the headphones of the present invention, the frame and/or the housing is made of resin or metal. The air hole edge fixing portion is formed in an annular shape according to the shape of the edge portion defining each air hole of the damping member, and has, on the inside thereof, a hole communicating with each air hole of the damping member.

Preferably, the speaker unit of the present invention is a speaker unit provided at the above-described headphones, the speaker unit including the damping member attached to cover the opening of the frame through which the sound wave emitted from the diaphragm passes.

Hereinafter, features of the present invention will be described.

The headphones of the present invention include the speaker unit having the diaphragm and the frame supporting the outer peripheral portion of the diaphragm, the housing configured to house the speaker unit, and the damping member made of the fibrous member exhibiting air permeability and attached to cover the opening of the frame through which the sound wave emitted from the diaphragm passes and/or the opening of the housing. The opening of the frame and the opening of the housing form, together with the damping member made of the material exhibiting air permeability, an acoustic circuit of the headphones. Further, the damping member has the one or more air holes formed by removal of the material forming the damping member.

In one preferred embodiment of the present invention, the secondary damping member is attached to the annular edge portion defining each air hole of the damping member, thereby reducing vibration of the edge portion. Thus, even when the air holes are provided at the damping member, the strength of the damping member can be held by the secondary damping member, and vibration of the periphery of each air hole, which has a great air flow rate, of the damping member can be reduced. The material of the secondary damping member is not limited as long as the secondary damping member reduces vibration of the edge portion. Preferably, any of the paper member, the non-woven fabric member, the woven fabric member, and the porous member formed in the annular shape according to the shape of the edge portion defining each air hole can be employed. As a result, the headphones of the present invention have proper acoustic properties, and exhibit excellent reproduced sound quality.

In another preferred embodiment of the present invention, the frame and/or the housing has the air hole edge fixing portion extending inward of the opening from the base defining the opening to fix the annular edge portion defining each air hole of the damping member. The air hole edge fixing portion has, on the inside thereof, the hole communicating with each air hole of the damping member, thereby reducing vibration of the edge portion of each air hole of the damping member. In a case where the frame and/or the housing is made of resin or metal, the air hole edge fixing portion may be formed in the annular shape according to the shape of the edge portion defining each air hole of the damping member. Thus, even when the air holes are provided at the damping member, the strength of the damping member can be held by the air hole edge fixing portion, and vibration of the periphery of each air hole, which has a great air flow rate, of the damping member can be reduced. As a result, the headphones of the present invention have proper acoustic properties, and exhibit excellent reproduced sound quality.

Note that in the speaker unit forming the above-described headphones of the present invention, the damping member is attached to cover the opening of the frame through which the sound wave emitted from the diaphragm passes. As in any of the above-described cases, the secondary damping member configured to reduce vibration of the edge portion of each air hole of the damping member may be provided, or the air hole edge fixing portion may be provided at the frame. Thus, the headphones exhibiting excellent reproduced sound quality can be produced.

According to the headphones and the speaker unit of the present invention, headphones and a speaker unit having proper acoustic properties and exhibiting excellent reproduced sound quality can be provided even in a case where an air hole is provided at a damping member.

DETAILED DESCRIPTION OF THE PREFERRED EMBODIMENTS

Hereinafter, an electroacoustic diaphragm and an electroacoustic transducer according to preferred embodiments of the present invention will be described, but the present invention is not limited to these embodiments.

Hereinafter, headphones and a speaker unit according to the preferred embodiments of the present invention will be described, but the present invention is not limited to these embodiments.

First Embodiment

Figure 1:
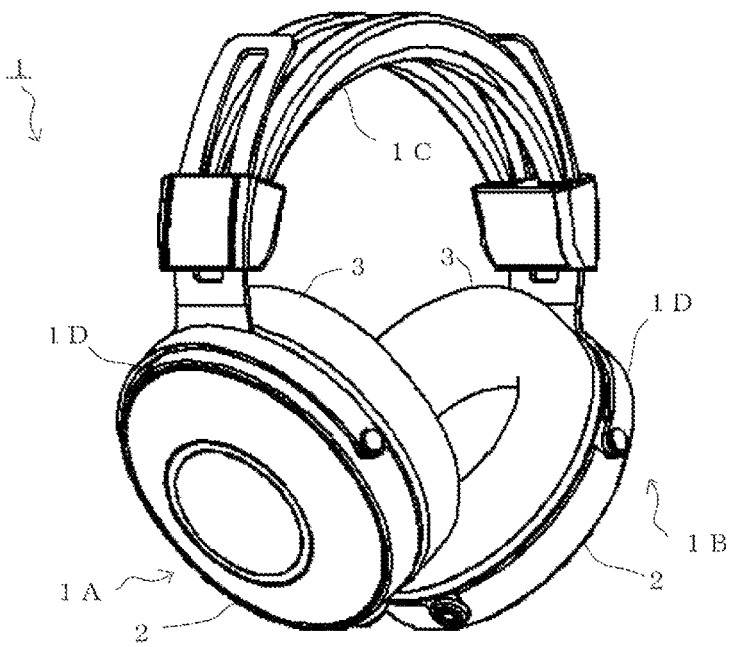
FIG. 1 is a view of an outer appearance of headphones of one embodiment of the present invention.

FIG. 1 is a view for describing headphones 1 according to the preferred embodiment of the present invention. Specifically, FIG. 1 is a perspective view of an outer appearance of the headphones 1. Note that the form of the headphones 1 is not limited to that in the case of the present embodiment. Other configurations of the headphones 1 not necessary for description of the present invention will not be shown in the figures and described.

The headphones 1 of the present embodiment include right and left headphone units 1A, 1B and a headband 1C coupling these headphone units 1A, 1B. Each of the headphone units 1A, 1B includes a housing 2 configured to house a speaker unit and an ear contact portion 3. The headband 1C is connected to each of coupling portions of hangers 1D, and the hangers 1D are each coupled to the housings 2.

The headphones 1 are provided with multiple holes 2*a* (illustrated in FIG. 2) at a side portion of each housing 2, and an internal space of the housing 2 communicates with the outside of the housing 2 on the outside of the ear contact portion 3 through the holes 2*a*. The headphones 1 can adjust the compliance (the acoustic capacity) of the internal space of the housing 2 by the holes 2*a*, and frequency properties, specifically low sound frequency properties, can be adjusted by compliance adjustment.

Figure 2:
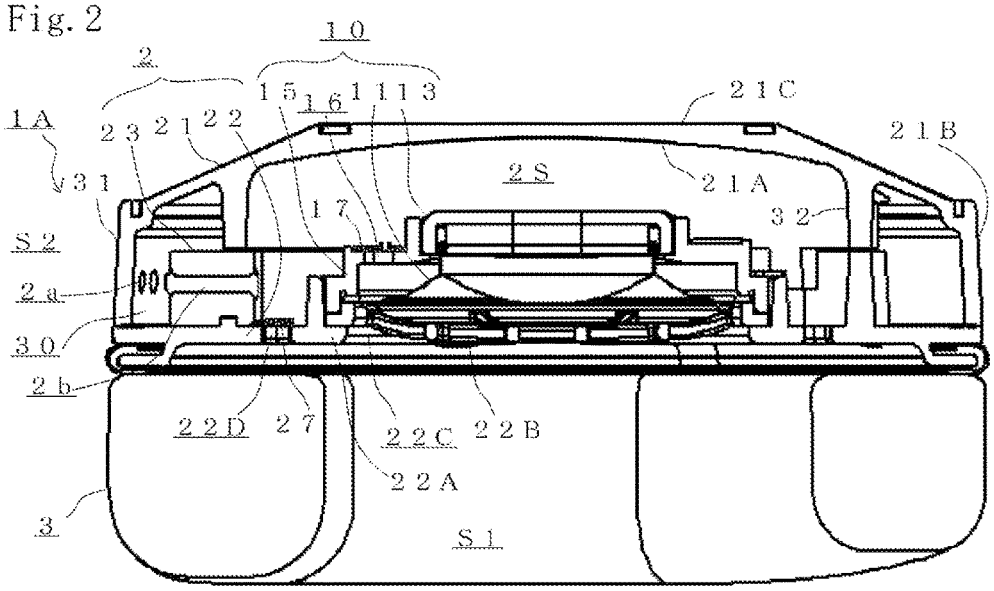
FIG. 2 is a view for describing a specific structure of a headphone unit of one embodiment of the present invention.

FIG. 2 is a view for describing a specific structure of the housing 2 including an internal space 2S and an air chamber 30 in one headphone unit 1A of the headphones 1 according to one embodiment of the present invention. FIG. 2 is a sectional view of an internal structure in the case of using a housing member 21 in the housing 2. As described above, each of the headphone units 1A, 1B of the headphones 1 includes the speaker unit 10, the housing 2 surrounding at least a back side of the speaker unit 10, and the ear contact portion 3 provided on a front side of the speaker unit 10. Each of the headphone units 1A, 1B can employ the housing 2 illustrated in FIG. 2.

The speaker unit 10 includes a diaphragm 11, a voice coil coupled to the diaphragm 11, a magnetic circuit 13 having a magnetic gap in which the voice coil is arranged, and a frame 15 supporting an outer peripheral portion of the diaphragm 11. The magnetic circuit 13 is supported by the frame 15, and is further coupled to a coupling member 22. The magnetic circuit 13 includes a plate, a magnet, and a yoke, and the above-described magnetic gap is formed between the plate and the yoke. The configuration of the speaker unit 10 is not limited to above, and various well-known forms such as formation of a magnetic gap between a magnet and a yoke can be employed.

The frame 15 of the speaker unit 10 of the present embodiment is configured such that a base thereof is made of resin, and defines multiple openings 16 through which a sound wave emitted from the diaphragm 11 passes toward a later-described internal space 2S side. A damping member 17 made of a material exhibiting air permeability is attached to cover the openings 16 of the frame 15. A specific configuration of the damping member 17 will be described later.

The housing 2 includes the coupling member 22 coupled to the speaker unit 10, and the housing member 21 surrounding the back side of the speaker unit 10. The housing member 21 includes a wall surface portion 21A defining the internal space 2S on the back side of the speaker unit 10, an outer peripheral cylindrical portion 21B, and a planer portion 21C. The hanger 1D is rotatably attached to the outer peripheral cylindrical portion 21B of the housing member 21. The coupling member 22 coupled to the housing member 21 includes a support portion 22A supporting the speaker unit 10. The support portion 22A protrudes inward of the housing 2, thereby supporting the frame 15 of the speaker unit 10. The coupling member 22 further includes a protection portion 22B facing an acoustic reflection surface of the speaker unit 10, and an opening 22C through which the diaphragm 11 of the speaker unit 10 is exposed. The ear contact portion 3 is attached to the coupling member 22.

The ear contact portion 3 includes an annular elastic member and a cover member covering the elastic member. The ear contact portion 3 is attached to the coupling member 22 of the housing 2 on an acoustic reflection side of the speaker unit 10. By contact with a listener's ear, the ear contact portion 3 divides the outside of the housing 2 into an inner space (an external space S1) of the ear contact portion 3 and the outside S2 on the outside of the ear contact portion 3. The external space S1 of the housing 2 on the inside of the ear contact portion 3 is a space communicating with the inside of the listener's ear. The outside S2 of the housing 2 on the outside of the ear contact portion 3 is divided from an internal space of the ear by the ear contact portion 3.

In the headphone unit 1A (1B), the internal space 2S of the housing 2 communicates with the external space S1 of the housing 2 on the inside of the ear contact portion 3. Specifically, the internal space 2S includes the housing member 21 forming the housing 2, the coupling member 22 coupled to the speaker unit 10, and a later-described hole formation member 23. The internal space 2S of the housing 2 communicates with the external space S1 of the housing 2 on the inside of the ear contact portion 3 through an opening 22D provided at the coupling member 22 of the housing 2. A damping member 27 made of a material exhibiting air permeability is attached to cover the opening 22D of the housing 2 of the present embodiment. A specific configuration of the damping member 27 will be described later.

The air chamber 30 is, at the housing 2, provided separately from the internal space 2S of the housing 2. The air chamber 30 may be provided on the inside of the housing 2 or the outside of the housing 2. Examples include a case where an air chamber is provided at an outer peripheral surface of the housing 2 on the outside of the housing 2, an inner peripheral surface of the housing 2 on an internal space side of the housing 2, or on the inside of a member forming the housing 2. The internal space 2S of the housing 2 communicates with the outside S2 of the housing 2 on the outside of the ear contact portion 3 through the air chamber 30. The air chamber 30 of the present embodiment is formed by components of the housing 2.

That is, the housing member 21 forming the housing 2, the coupling member 22 coupled to the speaker unit 10, and the later-described hole formation member 23 form the air chamber 30. The housing 2 includes the above-described air chamber 30 as a first air chamber, and the internal space 2S of the housing 2 as a second air chamber. The housing member 21 and the coupling member 22 define an inner wall portion 32 separating the internal space 2S and the air chamber 30.

As a result, the housing 2 has a double structure at part of a wall portion (the side portion), and includes an outer wall portion 31 and the inner wall portion 32. The air chamber (the first air chamber) 30 is arranged between the outer wall portion 31 facing the outside S2 of the housing 2 on the outside of the ear contact portion 3 and the inner wall portion 32 facing the internal space 2S of the housing 2. The outer wall portion 31 includes the first holes 2*a*, and in the illustrated example, is provided at the outer peripheral cylindrical portion 21B as the outer peripheral surface of the housing 2. The inner wall portion 32 includes the hole formation member 23 provided with second holes 2*b*.

The hole formation member 23 is a substantially cubic member of which length of one side is longer than the thickness dimension t2 of the inner wall portion 32, and is fixed to the inner wall portion with the hole formation member 23 being sandwiched between the housing member 21 and the coupling member 22. In the present embodiment, the hole formation member 23 is a block-shaped member having predetermined width, depth, and height dimensions longer than the thickness dimension t2, and is provided with the second holes 2*b* allowing communication between the internal space 2S and the air chamber 30 in a depth direction. Thus, the second hole 2*b* can form a through-hole of which entire length is longer than the dimension t2 of the inner wall portion 32.

With a long length of the second hole 2*b* of the hole formation member 23, the compliance of the internal space 2S and the air chamber 30 of the housing 2 can be adjusted, and the frequency properties, specifically the low sound frequency properties, can be adjusted by compliance adjustment. Three second holes 2*b* are formed at the hole formation member 23 of the present embodiment. The hole formation member 23 is the substantially cubic member, and therefore, the number of multiple second holes 2*b* is adjusted so that the compliance can be adjusted.

In the illustrated example, the housing 2 is configured such that a component of the coupling member 22 and a component of the housing member 21 are connected together. The air chamber (the first air chamber) 30 is provided in the vicinity of a connection position between the coupling member 22 and the housing member 21. Specifically, the air chamber 30 is provided at the connection position between the coupling member 22 and the housing member 21 in a radial direction of the housing 2. Alternatively, the air chamber 30 may be formed by part of the coupling member 22 and part of the housing member 21, or may be formed by the entirety of the coupling member 22 and the entirety of the housing member 21.

Figure 3A:
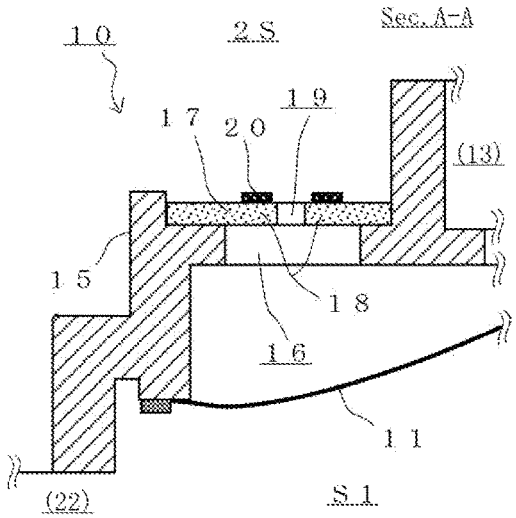
FIGS. 3A and 3B are views for describing a specific structure of a speaker unit of the headphones of one embodiment of the present invention.
Figure 3B:
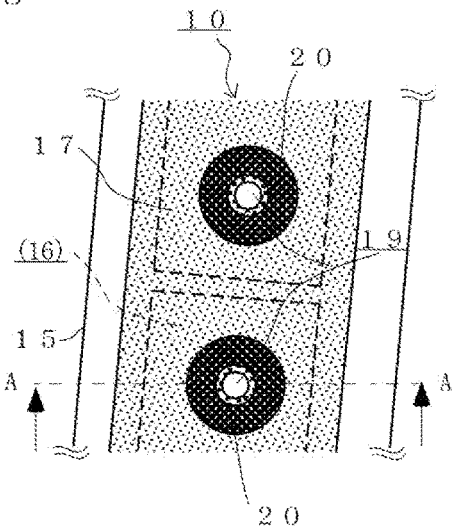

FIGS. 3A and 3B are views for describing the structure of the speaker unit 10 used for the headphone unit 1A (or 1B). Specifically, FIG. 3B is an enlarged partial view of an outer peripheral side of the frame 15 of the speaker unit 10 from the back side (i.e., the internal space 2S side), and FIG. 3A is an enlarged partial sectional view of the speaker unit 10 along an A-A line of FIG. 3B. Note that in FIGS. 3A and 3B, other configurations unnecessary for description, such as the magnetic circuit 13 and the coupling member 22, are not shown in the figures.

The damping member 17 formed of a fibrous member exhibiting air permeability is attached to the frame 15 of the speaker unit 10 to cover the openings 16 through which the sound wave emitted from the diaphragm 11 passes toward the internal space 2S. The damping member 17 of the present embodiment is a paper material with a predetermined thickness, and a peripheral portion of the paper material is bonded to the periphery of the openings 16 from the back side of the frame 15. Multiple air holes 19 are formed at predetermined positions of the damping member 17.

The air holes 19 of the damping member 17 are portions from which fibers as the material forming the damping member 17 are removed, and are each substantially defined by annular edge portions 18. Each edge portion 18 includes an end surface defining the air hole 19, and a peripheral portion of the end surface and the air hole 19. The illustrated air hole 19 is a circular hole defined by the circular edge portion 18, but the shape of the air hole 19 may be a polygonal shape such as a triangular shape or a quadrangular shape or an oval shape as long as the shape of the air hole 19 is defined by the annular edge portion 18. Note that in a case where the damping member 17 is made of other materials exhibiting air permeability, the air holes 19 of the damping member 17 may be portions where the material of such a damping member 17 is not present by removal etc.

The damping member 17 is formed of the paper member exhibiting air permeability, and therefore, exhibits a predetermined level of air permeability even at a portion not provided with the air holes 19. Note that higher air permeability is exhibited by the air holes 19 where no fibers are present, and therefore, air permeability per unit area is higher in the case of providing the damping member 17 with the air holes 19 than in the case of providing the damping member 17 without the air holes 19. When the diaphragm 11 of the speaker unit 10 vibrates, if the amount of air passing through the air holes 19 is increased, unnecessary vibration of the edge portions 18 of the air holes 19 of the damping member 17 might be caused.

In the case of the present embodiment, a secondary damping member 20 is attached to each of the annular edge portions 18 defining the air holes 19 of the damping member 17. The secondary damping member 20 is an annular member corresponding to the circular air hole 19 and the circular edge portion 18. In the present embodiment, the secondary damping member 20 is made of ethylene-vinyl acetate (EVA: ethylene-vinyl acetate copolymer) as a porous member, and is attached to the damping member 17 with a double-sided tape or an adhesive. An inner hole of the secondary damping member 20 is positioned substantially concentrically with respect to the air hole 19 of the damping member 17, and therefore, the air hole 19 is not closed by the secondary damping member 20.

The secondary damping member 20 is the annular member having predetermined width and thickness. Thus, when the secondary damping member 20 is attached to the annular edge portion 18 defining each air hole 19 of the damping member 17, the secondary damping member 20 reinforces the edge portion 18. Thus, the secondary damping member 20 can reduce vibration of the edge portion 18 of the air hole 19 of the damping member 17, and occurrence of an unnecessary sound wave such as noise due to vibration can be reduced. Thus, the reproduced sound quality of the headphones 1 can be enhanced.

Note that the secondary damping member 20 may be the annular member corresponding to the circular edge portion 18, and may be other members formed of fibrous members and exhibiting air permeability, such as a paper member, anon-woven fabric member, and a woven fabric member. Needless to say, the secondary damping member 20 may be an annular member not exhibiting air permeability, such as a washer made of resin or metal, as long as the secondary damping member 20 can reduce vibration of the edge portion 18 of the air hole 19 of the damping member 17 to reduce occurrence of the unnecessary sound wave.

Figure 4:
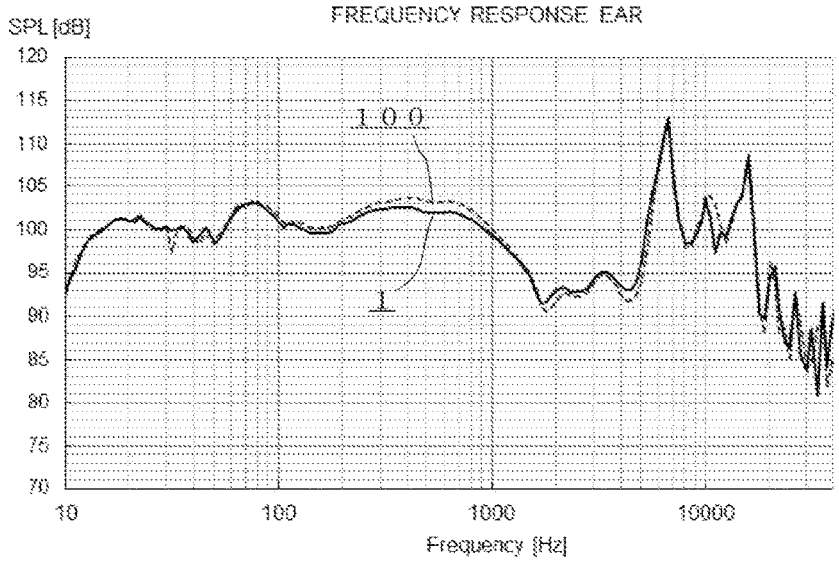
FIG. 4 shows graphs of sound pressure frequency properties of the headphones of one embodiment of the present invention.

FIG. 4 shows graphs of sound pressure frequency properties of the headphones 1. Specifically, the sound pressure frequency properties of the headphones 1 (a solid line) including the speaker unit 10 of the present embodiment and the sound pressure frequency properties of (not-shown) headphones 100 (a dashed line) including a (not-shown) speaker unit different from the above-described speaker unit 10 only in a point that no secondary damping members 20 are provided as a comparative example are illustrated to overlap with each other. For the graphs, the horizontal axis represents a frequency, and the vertical axis represents a sound pressure level in the inner space (the external space S1) of the ear contact portion 3.

In the case of the headphones 1 of the present embodiment, the secondary damping member 20 is bonded to the edge portion 18 defining each air hole 19 of the damping member 17. Thus, as compared to the case of the headphones 100 of the comparative example, the sound pressure level in a midrange is decreased, and the sound pressure level in a mid-high range is increased. As a result of comparative listening, better reproduced sound quality of the headphones 1 can be confirmed as compared to that of the headphones 100. This is because of the following reasons: in the case of the present embodiment, the secondary damping member 20 can reinforce each edge portion 18 of the damping member 17 to reduce occurrence of the unnecessary sound wave such as noise due to unnecessary vibration.

Note that in the present embodiment, the damping member 17 is attached to cover the openings 16 of the frame 15 of the speaker unit 10. The secondary damping member 20 is attached to the edge portion 18 defining each air hole 19 of the damping member 17. Thus, the headphones 1 can be produced when the speaker unit 10 is attached to the housing 2. That is, the speaker unit 10 can be taken as a component suitable for production of the headphones 1 exhibiting excellent reproduced sound quality by means of the speaker unit 10 alone.

Note that even in a case where the damping member is attached to cover any of the openings of the housing 2 in the headphones 1, the secondary damping member can be similarly provided for the edge portion defining such an air hole. For example, the damping member 27 made of the material exhibiting air permeability is attached to cover the opening 22D of the housing 2 of the present embodiment. As in the damping member 17, the damping member 27 is provided with multiple (not-shown) air holes at predetermined positions. Thus, a (not-shown) secondary damping member may be attached to reinforce an edge portion of each air hole of the damping member 27.

That is, for at least one or both of the damping member attached to the frame 15 of the speaker unit 10 and the damping member covering any of the openings of the housing 2, the secondary damping member may be attached to reinforce the edge portion of each air hole of the damping member of the headphones 1. In a case where the multiple damping members covering the openings of the housing 2 are provided, the secondary damping member may be provided to reinforce the edge portion of each air hole of at least any of the damping members.

Second Embodiment

Figure 5A:
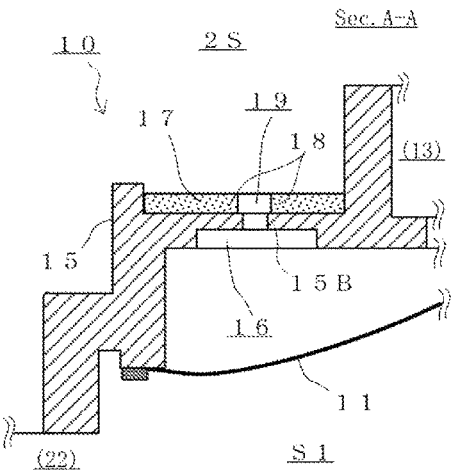
FIGS. 5A and 5B are views for describing a specific structure of another speaker unit of headphones of one embodiment of the present invention.
Figure 5B:
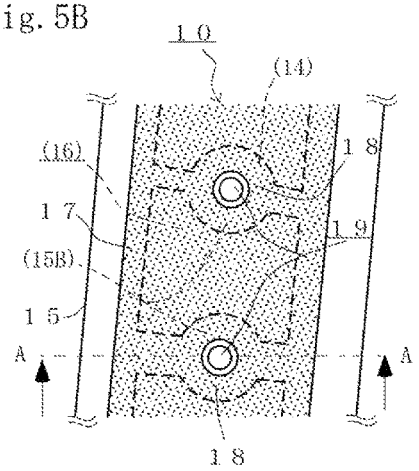

FIGS. 5A and 5B are views for describing the structure of another speaker unit 10A used for a headphone unit 1A (or 1B). The speaker unit 10A of the present embodiment is different from the speaker unit 10 of the above-described embodiment in part of the configuration of a frame 15A and a point that no secondary damping member 20 is provided, and other configurations of the speaker unit 10A are common to those of the speaker unit 10. Thus, the same reference numerals are used to represent common configurations, and description thereof will not be repeated.

Specifically, as in FIGS. 3A and 3B, FIG. 5B is an enlarged partial view of an outer peripheral side of the frame 15A of the speaker unit 10A from a back side (i.e., an internal space 2S side), and FIG. 5A is an enlarged partial sectional view of the speaker unit 10A along an A-A line of FIG. 5B.

In the frame 15A of the speaker unit 10A, an air hole edge fixing portion 15B for fixing an annular edge portion 18 defining an air hole 19 of a damping member 17 is, in an opening 16 through which a sound wave emitted from a diaphragm 11 passes toward an internal space 2S, formed to extend inward of a base defining the opening 16. The damping member 17 is a paper material with a predetermined thickness, and a peripheral portion of the paper material is bonded to the periphery of the opening 16 from the back side of the frame 15A. The damping member 17 is provided with the multiple air holes 19 at predetermined positions. Thus, each air hole edge fixing portion 15B includes, on the inside thereof, a hole communicating with the air hole 19 of the damping member 17. The inner hole of the air hole edge fixing portion 15B is positioned substantially concentrically with respect to the air hole 19 of the damping member 17, and therefore, the air hole 19 is not closed by the air hole edge fixing portion 15B.

In the frame 15A, the air hole edge fixing portion 15B is an annular portion extending inward of the base defining the opening 16. Thus, when the damping member 17 is attached to the air hole edge fixing portion 15B, the air hole edge fixing portion 15B reinforces the annular edge portion 18 defining the air hole 19 of the damping member 17. Thus, the air hole edge fixing portion 15B can reduce vibration of the edge portion 18 of the air hole 19 of the damping member 17, and therefore, can reduce occurrence of an unnecessary sound wave such as noise due to vibration. Consequently, the reproduced sound quality of headphones 1 can be enhanced.

Note that the air hole edge fixing portion 15B may be an annular portion corresponding to the circular edge portion 18. Even in a case where the frame 15A is made of metal, the air hole edge fixing portion 15B may be similarly formed to extend inward of the base defining the opening 16. The air hole edge fixing portion 15B may be provided at one or more spots.

Note that in the present embodiment, the damping member 17 is also attached to cover the openings 16 of the frame 15A of the speaker unit 10A. The edge portion 18 defining each air hole 19 of the damping member 17 is attached to the air hole edge fixing portion 15B formed to extend inward of the base defining the opening 16 of the frame 15A. Thus, the speaker unit 10A can be taken as a component suitable for producing the headphones 1 exhibiting excellent reproduced sound quality by the speaker unit 10A alone.

Note that even in a case where the damping member is attached to cover any of openings of a housing 2 in the headphones 1, the air hole edge fixing portion can be also provided at the housing 2. For example, a damping member 27 made of a fibrous material exhibiting air permeability is attached to cover an opening 22D of the housing 2 of the present embodiment. As in the damping member 17, the damping member 27 is provided with multiple (not-shown) air holes at predetermined positions. Thus, a (not-shown) air hole edge fixing portion extending inward of the opening 22D from a base defining the opening 22D may be attached to reinforce an edge portion of each air hole of the damping member 27.

That is, for at least one or both of the damping member attached to the frame 15A of the speaker unit 10A and the damping member covering any of the openings of the housing 2, the air hole edge fixing portion may be attached to reinforce the edge portion of each air hole of the damping member of the headphones 1. In a case where the multiple damping members covering the openings of the housing 2 are provided, the air hole edge fixing portion may be provided to reinforce the edge portion of each air hole of at least any of the damping members.

Note that in FIG. 1, cord and plug portions of the headphones 1 for stereo reproduction are not shown. The headphones 1 may be wireless headphones not including cord and plug portions for supplying an audio signal and including a receiver configured to receive a wireless signal.

The headphones of the present invention are not limited to the illustrated overhead headphones, but may be headphones including other ear hooking portions. Moreover, the present invention is not limited to the headphones, but is also applicable to earphones, canal earphones, etc. Moreover, the headphones and the earphones of the present invention are not limited to stereo reproduction or multichannel surround reproduction for home use, but are also applicable to in-vehicle audio equipment and sound reproduction facilities such as movie theaters.

What is claimed is:

1. Headphones comprising:

a speaker unit including a diaphragm and a frame supporting an outer peripheral portion of the diaphragm;

a housing configured to house the speaker unit; and a damping member made of a material exhibiting air permeability and attached to cover an opening of the frame through which a sound wave emitted from the diaphragm passes and/or an opening of the housing, wherein the damping member has one or more air holes formed by removal of the material forming the damping member, and one or more secondary damping members each including a hole aligned with a corresponding one of the one or more air holes in the damping member, the one or more secondary damping members being attached to an annular edge portion of the corresponding one of the one or more air holes defining the air hole.

2. The headphones according to claim 1, wherein each of the one or more secondary damping members is any of a paper member, a non-woven fabric member, a woven fabric member, and a porous member formed in an annular shape according to a shape of the edge portion defining each air hole.

3. The speaker unit provided at the headphones according to claim 1, comprising:

the damping member attached to cover the opening of the frame through which the sound wave emitted from the diaphragm passes.

* * * * *